United States Patent [19]

Wieland

[11] Patent Number: 4,829,898

[45] Date of Patent: May 16, 1989

[54] PRINTING INK SUPPLY METERING SYSTEM

[75] Inventor: Erich G. Wieland, Würzburg, Fed. Rep. of Germany

[73] Assignee: Koenig & Bauer Aktiengesellschaft, Würzburg, Fed. Rep. of Germany

[21] Appl. No.: 86,620

[22] Filed: Aug. 18, 1987

[30] Foreign Application Priority Data

Aug. 21, 1986 [DE] Fed. Rep. of Germany ..... 3628464

[51] Int. Cl.[4] ..... B41F 3/04; B41F 3/06

[52] U.S. Cl. ..... 101/483; 101/365; 101/DIG. 45

[58] Field of Search ..... 101/365, 350, 148, 207–210, 101/DIG. 24, 26, 211, 426

[56] References Cited

U.S. PATENT DOCUMENTS 3,707,123 12/1972 Heasman et al. ..... 101/207

FOREIGN PATENT DOCUMENTS 2944322 7/1981 Fed. Rep. of Germany ... 101/DIG. 24

3217569 11/1983 Fed. Rep. of Germany .

*Primary Examiner*—J. Reed Fisher

*Attorney, Agent, or Firm*—Jones, Tullar & Cooper

[57] ABSTRACT

A method for measuring and regulating the amount of printing ink supplied by an ink fountain roller to a vibrator roller includes passing the ink fountain roller past a measuring bar which measures ink thicknesses and angles of duration. This data is then utilized to ascertain a volume of ink transferred with this information being then compared with a pre-selected set point volume. Adjustments to the ink metering gap for each ink doctor blade can then be made so that the ink volume actually transferred will be the same as the set point value.

1 Claim, 1 Drawing Sheet

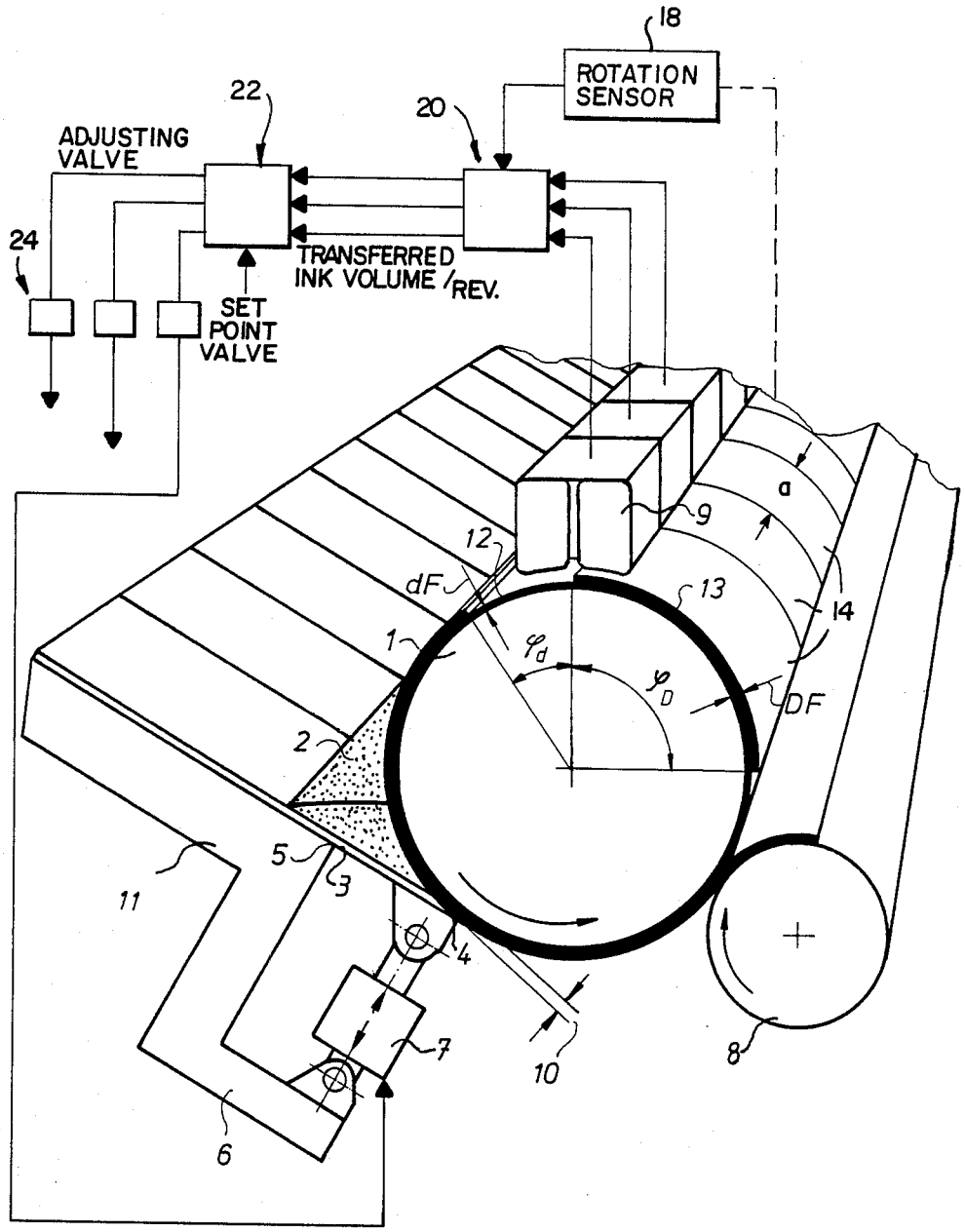
18
ROTATION SENSOR
22
20
ADJUSTING VALVE
24
TRANSFERRED INK VOLUME /REV.
SET POINT VALVE
a
9
12
dF
13
14
1
$\varphi_d$
$\varphi_D$
DF
2
5
3
11
4
7
10
8
6

PRINTING INK SUPPLY METERING SYSTEM

FIELD OF THE INVENTION

The present invention is directed generally to a printing ink supply metering system. More particularly, the present invention is directed to a method for measuring and regulating a supply of printing ink. Most specifically, the present invention is directed to a method for measuring and regulating the amount of printing ink supplied by an ink fountain roller in a sheet fed rotary printing machine. Printing ink carried by the ink fountain roller in an ink fountain apparatus is periodically removed by a vibrator roller which intermittently contacts the surface of the ink fountain roller. Ink thicknesses on the ink fountain roller in areas contacted by the vibrator roller and in areas not so contacted are measured as are the angular durations of each such area. These measurements are then used to calculate actual ink volumes supplied, and to compare these with desired values. Adjustments to the amount of ink being supplied to the ink fountain roller's surface can then be made to regulate the amount of ink supplied in accordance with the method of the present invention.

DESCRIPTION OF THE PRIOR ART

Various ink fountain assemblies, which are used to supply printing ink to sheet fed rotary printing assemblies, are generally well known in the art. One concern which these assemblies raise is that of measuring and regulating the thickness of the ink layer that each ink fountain assembly provides. Devices for measuring and regulating this ink thickness layer on the surface of, for example, an ink fountain roller are hence generally known. For instance, German application DE-OS No. 3217569 discloses an assembly which, by zones, determines an ink layer thickness by means of a plurality of sensors distributed over the entire length of an ink roller and executes a set point comparison based on several operational parameters, such as viscosity of the ink in a metering gap and/or a supply of wetting agent and/or a peripheral speed of the ink roller and then readjusts an adjustable metering gap formed by an ink doctor blade and the ink roller via a regulating member.

In a prior art ink measuring system of the type generally as discussed above, the ink sensors are situated, in the direction of rotation of the ink roller, after the ink metering gap but ahead of the ink transfer roller. Thus the thickness of ink that is detected and measured is that which is supplied to the ink roller but not that which is actually supplied to the ink transfer roller. Accordingly, there is not provided a measurement of the amount of ink supplied to the printing equipment but only the amount of ink supplied to the ink roller.

Various other methods are generally known for use in measuring the thickness of the ink layer supplied through a metering gap to an ink fountain roller. These prior art methods have been apt to be slow and inaccurate and, as in the above discussed assembly, have not provided a measure of the amount of ink supplied from the ink roller to the printing equipment. Accordingly, there is a need for a method for ascertaining rapidly and accurately the amount to ink supplied to an inking system, and for regulating a metering system to supply a desired or pre-set amount of printing ink. The printing ink supply measuring and regulating method of the present invention provides such a system.

SUMMARY OF THE INVENTION

It is an object of the present invention to provide a printing ink supply metering system.

Another object of the present invention is to provide a method for measuring and regulating a printing ink supply.

A further object of the present invention is to provide an ink supply measuring and regulating method for an inking system using an ink fountain roller.

Still another object of the present invention is to provide a method for measuring and regulating an ink metering device to measure and regulate the amount of ink supplied to an ink applicator roller.

Yet a further object of the present invention is to provide a method for measuring and regulating the amount of ink supplied from an ink fountain roller to a reciprocating ink vibrator roller.

As will be set forth in greater detail in the description of the preferred embodiment which is set forth subsequently, the method for measuring and regulating an ink supply in an inking system for a sheet fed rotary printing assembly in accordance with the present invention utilizes an ink thickness measuring means placed, in the direction of rotation of the ink fountain roller, after this roller has been contacted by a reciprocating or oscillating vibrator roller. The vibrator roller periodically moves into contact with the ink fountain roller, takes ink from its surface, and moves away to transfer this ink. Thus the surface of the ink fountain roller has areas of thick ink coating and areas of thin ink coating. In accordance with the method of the present invention, the thicknesses of the ink layer in these two areas, as well as their sizes are measured. These values then can be used to determine an ink volume amount actually provided. This volume can then be compared to a desired amount. The ink metering gap of the ink fountain can then be adjusted as necessary. A computer may be used to receive the data and to perform the necessary calculations.

The method for measuring and regulating a printing ink supply in accordance with the present invention is particularly advantageous since it compensates for physical properties of the printing ink, particularly for changes in viscosity. This makes the work of the press operator easier and also reduces waste sheets, especially at the start of a run. When the sheet fed rotary printing machine whose ink supply is being measured and regulated in accordance with the method of the present invention is being used for a number of short runs, this reduction in spoilage has an enormous cost savings over prior art methods. The printing ink supply metering and regulating method of the present invention, in contrast to prior systems and methods, measures the volume of ink actually taken off the ink fountain roller. This value represents the amount of ink actually supplied to the printing equipment. As such, the measuring and regulating method of the present invention provides a substantially improved method of operation over prior art devices and affords significant operational and cost saving benefits to the owner.

BRIEF DESCRIPTION OF THE DRAWING

While the novel features of the printing ink measuring and regulating method in accordance with the present invention are set forth with particularity in the appended claims, a full and complete understanding of the invention may be had with reference to the description of the preferred embodiments, as set forth subsequently and as is illustrated in the accompanying sole drawing figure which is a schematic perspective view of a portion of an ink fountain assembly in accordance with the present invention.

DESCRIPTION OF THE PREFERRED EMBODIMENT

Referring now to the sole drawing figure, there may be seen a portion of an ink fountain assembly for use in supplying printing ink to a sheet fed rotary printing machine (not shown). An ink fountain or doctor roller 1 of the ink fountain assembly is mounted for rotation in side portions of the ink fountain assembly (not shown) and is driven in a counterclockwise direction, as indicated by the arrow on the end of ink fountain roller 1, in a conventional manner. The peripheral surface of ink fountain roller 1 is coated or moistened with printing ink from a printing ink supply 2.

Printing ink 2 is carried in a generally conventional ink fountain, generally at 11, a portion of which is formed by the periphery of ink fountain roller 1. A plurality of doctor blades 3 are positioned generally beneath ink fountain roller 1 and have first ends 4 which are generally longitudinal to the ink fountain roller 1. A second end of such of these doctor blades 3 overlies an edge portion 5 of a support transverse 6 of the ink fountain assembly 11. This ink fountain support traverse 6 extends across the width of the ink fountain 11 and may be attached at its ends to the side mounts (not shown) of the ink fountain assembly.

A plurality of these individual doctor blades 3 are placed adjacent each other and extend across the width of ink fountain 11. Each of these doctor blades 11 has its own adjusting means 7 which, as may be seen in the drawing, extends between support traverse 6 and first or free end 4 of each doctor blade 3. By operation of the adjusting means 7, it will thus be understood that free end 4 of each doctor blade 3 may be moved toward or away from the peripheral surface of ink fountain roller 1. This accordingly allows the control of a metering gap 10 formed between the free end 4 of each doctor blade 3 and the periphery of ink fountain roller 1. Operation of adjusting means 7 will change the size of the metering gap 10. The specific structure of adjusting means 7 forms no part of the present invention as devices of this general type are known in the art.

A vibrator roller 8 is located generally adjacent ink fountain roller 1 with the axes of ink fountain roller 1 and vibrator roller 8 being generally parallel. The vibrator roller 8 is secured in the side mounts of the ink fountain assembly by means of a generally known control means (not shown) so that it oscillates or reciprocates periodically between a first portion shown in the sole drawing figure in which its periphery contacts the periphery of ink fountain roller 1 and a second position in which its periphery contacts the surface of an ink application roller (not shown).

The line of contact between vibrator roller 8 and ink fountain roller 1 is after, in the direction of rotation of roller 1, the metering gap 10 formed between ink fountain roller 1 and the adjacent ends 4 of the plurality of doctor blades 3.

As may also be seen in the sole drawing figure, an elongated measuring bar 9 is placed generally adjacent the periphery of the ink fountain roller 1 and after, in the direction of rotation of roller 1, the vibrator roller 8. This elongated measuring bar 9 is divided into a plurality of ink measuring zones 14 with the width "a" of each such zone 14 corresponding to the width of an ink doctor blade 3. The measuring bar 9 has a plurality of zone wide measuring devices which may operate for example, optically or in accordance with resistance measuring principles to measure thickness of the ink layer on the surface of the ink fountain roller 1.

In operation, ink fountain roller 1 picks up printing ink from the printing ink supply 2 carried in ink formation 11. This printing ink 2 is carried out of the ink fountain on the surface of ink fountain roller 1 and has a particular thickness which is determined by the metering gap 10 formed by the spacings of the first ends 4 of doctor blades 3 from the surface of ink fountain roller 1. As the ink fountain roller 1 turns in its counterclockwise direction, vibrator roller 8 moves into peripheral surface contact with it for a pre-determined dwell time. As a result of this dwell time, a printing ink thickness relief remains on the surface of ink fountain roller 1 since a portion of the ink originally on roller 1 has been transferred to vibrator roller 8. This results in the creation of alternating thinner printing ink layers 12 and thicker printing ink layers 13 on the surface of ink fountain roller 1. The thinner printing ink layers 12 correspond to the amount of ink remaining on the ink fountain roller 1 after contact with, and transfer of ink to vibrator roller 8; while the thicker printing ink layers 13 are those areas of the ink fountain roller 1 not contacted by vibrator roller 8.

By means of the measuring bar 9, the thickness DF of the untouched thicker printing ink layer 13 and the thickness dF of the thinner printing ink layer 12 can be measured either continuously of intermittently. In addition to each measurement of the thickness dF and DF of the ink layers, the associated covering angles $\phi_d$ and $\phi_D$ are measured, by a rotation sensor generally at 18, the covering angles $\phi_d$ and $\phi_D$ being understood to be the angles with which the ink fountain roller 1 is covered on its periphery by a thin remaining ink layer 12 of a thicker, untouched printing ink layer 13, as viewed in the peripheral direction.

By means of a first electronic evaluation unit, shown generally at 20, it is now easily possible to detect and evaluate the limits of the sudden printing ink rises or falls which are measured by means of the measuring bar 9 through the determination of the covering angles $\phi_d$, $\phi_D$ in connection with the respectively measured printing ink thicknesses dF, DF. In this electronic evaluation unit 20, such as a computer, the printing ink volumes $V_{13}$ and $V_{12}$ of the printing ink layers 13 and 12 are calculated for each revolution of the ink fountain roller 1 by means of the angle $\phi_D$ or $\phi_d$ and the associated printing ink thickness DF and dF for each ink zone and a difference $V_{13}$ minus $V_{12}$ for each ink zone 14 is formed. This difference is equal to the volume of the amount of printing ink transferred to the vibrator roller 8 during each revolution of the ink fountain roller 1, and over each ink zone it provides an actual value.

The actual calculated value for ink volume transferred during each revolution of the ink fountain roller 1 is compared with a pre-selected desired set point value for a particular amount of printing ink that ideally should be transferred. This comparison may, if desired, be accomplished by use of a second electronic evaluation unit 22, such as a computer, and an adjusting value may then be formed using the difference between the actual ink transfer volume and the desired set point value. This adjusting value will then be supplied to an amplifier 24, such as a voltage amplifier, or a similar means. This amplifier then acts in an appropriate manner on the doctor blade adjusting means 7 for each doctor blade 3 to adjust the metering gap 10. This adjustment is performed for each of the several ink zones 14 formed by each of the doctor blades 3 by operation of each of the doctor blade adjusting means 7.

The method for measuring and regulating printing ink supply in accordance with the present invention is operative even with changes in the viscosity of the printing ink. As the viscosity changes, either more or less printing ink will exit through the metering gap 10 so that the printing ink layer 13 that is created will diverge from the set point value previously selected. When this occurs, the method, as discussed above, will cause the adjusting means 7 to vary the metering gap 10 so that the set point value is again arrived at.

While a preferred embodiment of a method for measuring and regulating the amount of printing ink supplied by an ink fountain roller to a vibrator roller in an inking fountain for a sheet fed rotary printing machine in accordance with the present invention has been fully and completely set forth hereinabove, it will be apparent to one of skill in the art that a number of changes in, for example, the number of doctor blades, the particular doctor blade adjusting means, the size of the ink transfer roller, the means used to reciprocate the vibrator roller and the like could be made without departing from the true spirit and scope of the subject invention which is accordingly to be limited only by the following claims.

What is claimed is:

1. A method for measuring and regulating an amount of printing ink passed on by an ink fountain roller in an inking system for a sheet fed rotary printing machine comprising the steps of:

supplying printing ink to each of a plurality of ink zones on said ink fountain roller;

passing on at least a portion of said printing ink from at least selected ones of said plurality of ink zones;

determining a covering angle and an ink thickness for each untouched printing ink layer on said ink fountain roller before said printing ink is passed on, and for each printing ink remaining layer after said printing ink bias has been passed on for each of said plurality of ink zones on said ink fountain roller;

utilizing said covering angle and said untouched and remaining ink layer thicknesses to determine an actual volume of said ink passed on for each revolution of said ink fountain roller by each of said plurality of ink zones on said ink fountain roller;

supplying said actual volume determination to an electronic evaluation unit;

comparing said actual value determination in the electronic evaluation unit with a set point value and forming an adjusting value for each said ink zone; and actuating a doctor blade adjusting means for each said ink zone in accordance with said adjusting value to regulate the amount of printing ink supplied to each said ink zone of said ink fountain roller by each said doctor blade to thereby regulate said amount of printing ink passed on by each said ink zone of said ink fountain roller.

* * * * *